United States Patent [19]

Cole

[11] 4,040,951

[45] Aug. 9, 1977

[54] APPARATUS FOR RETAINING AND READILY RELEASING A SHAKER SCREEN

[76] Inventor: Kenneth Raymond Cole, R.D. 1 Smith Road, Sussex, N.J. 07461

[21] Appl. No.: 641,310

[22] Filed: Dec. 16, 1975

[51] Int. Cl.[2] ..... B07B 1/42

[52] U.S. Cl. ..... 209/408; 209/399

[58] Field of Search ..... 209/403, 405, 408, 399, 209/319, 395; 101/127.1, 128.1, 415.1

[56] References Cited

U.S. PATENT DOCUMENTS

| | | | |
|---|---|---|---|
| 1,103,862 | 7/1914 | Bennett | 101/415.1 |
| 2,036,607 | 4/1953 | Roubal | 209/395 |
| 2,190,993 | 2/1940 | Muir | 209/405 X |
| 2,477,123 | 7/1949 | Gilson | 209/319 |
| 2,706,932 | 4/1955 | Smith | 209/405 |
| 2,899,061 | 8/1959 | Schluth | 209/408 |
| 3,087,617 | 4/1963 | Forsberg | 209/403 X |
| 3,282,423 | 11/1966 | Mitchell | 209/403 X |

FOREIGN PATENT DOCUMENTS

| | | | |
|---|---|---|---|
| 1,014,628 | 6/1952 | France | 209/403 |

*Primary Examiner*—Robert Halper
*Attorney, Agent, or Firm*—Ralph R. Roberts

[57] ABSTRACT

Two arrangements for retaining a screen in and on a shaker frame are shown. Both arrangements provide apparatus for the ready removal and replacement of the screen in the shaker frame. The first arrangement provides apparatus for screens having one-quarter inch and larger openings. In this apparatus a multiplicity of T-bolts is employed. The heads of these T-bolts cover two or three screen openings while the shanks of the bolts pass through an opening in the screen without damage. The threaded ends of these bolts are turned into the threaded portions of T-nuts whose head portions are slidably carried on a rectangular bar disposed transversely of the frame. There is a plurality of these transverse bars each of whose ends is actuated up or down by a toggle mechanism. When the bars are moved downwardly by the toggle mechanisms the T-bolts which are retained by the T-nuts snugly retain the screen on fixed ribs on the screen frame. For screens with smaller openings a second apparatus is provided. In this arrangement the transverse bars are disposed above the screen. On these bars are carried depending arms which terminate with pad members which press and retain the screen on and to the ribs of the shaker frame. These transverse rods are secured to and are moved toward and away from the screen by toggle mechanisms. In the down position the toggle mechanisms push the pad members into screen holding condition. In the up condition the pad members are lifted and maintained a few inches above the screen so that the screen is free for removal and replacement.

8 Claims, 7 Drawing Figures

APPARATUS FOR RETAINING AND READILY RELEASING A SHAKER SCREEN

BACKGROUND OF THE INVENTION

1. Field of the Invention

With reference to the classification of art as established in the United States Patent and Trademark Office the present invention is found in the general Class entitled, "Classifying, Separating and Assorting Solids" (Class 209) and in the subclass entitled, "sifting-ataching perforated sheet" (subclass 399).

2. Description of the Prior Art

Shaker screens for sifting sand, rock and the like are well known and are conventionally constructed of woven screen or perforated metal. One of the problems encountered in the use of such a shaker screen is the replacement of the screen portion when it is damaged or worn out through the abrasive action of the material which is being sifted. It is well known to retain these screens by means of screws mounted in appropriately threaded portions of the frame but insofar as is known a ready replacement mechanism whereby these screen may be readily lifted from the frame and replaced in the matter of a minute or two has not heretofore been accomplished.

Examples of various patents directed toward the securing of screens to shaker frames are shown in several United States Patents among which are: U.S. Pat. No. 656,098 to M. R. DRISCOLL as issued on Aug. 14, 1900; U.S. Pat. No. 981,249 to L. A. DIETRICK as issued on Jan. 10, 1911; U.S. Pat. No. 1,353,545 to T. J. STURTEVANT as issued on Sept. 21, 1920; U.S. Pat. No. 1,545,679 to L. L. MILLER as issued on July 14, 1925; U.S. Pat. No. 1,711,548 to L. E. SOLDAN as issued on May 7, 1929; U.S. Pat. No. 2,114,329 to D. M. BLACKBURN as issued on Apr. 19, 1938 and U.S. Pat. No. 2,706,932 to R. E. SMITH as issued on Apr. 26, 1955.

In these and the other apparatus that are known the attachment of the screen is a slow and tedious project whereas in the present invention the replacement of the screen is easily accomplished and the retaining of the screen is virtually foolproof.

SUMMARY OF THE INVENTION

The present invention utilizes a conventinal shaker screen and frame. Instead of the normal attaching of the screen to the frame as by screws, soldering, welding and the like, in this invention the removable screen is held down by pressure pads actuated by toggle mechanisms which hold the screen against a grid that is a part of the frame of the conventional shaker. The suppport grid for the screen is conventional but the retaining of the screen against this grid is provided through pads carried by transverse bars which are actuated by a toggle mechanism. These bars are maintained at two levels of operation. In the upper limit of operation the pressure pads carried by these bars are free of the screen and in the lifted condition the screen is readily released and removed from the support frame. In the down position these transverse rods, which are moved into position by the toggle mechanisms, press pad-like portions onto the screen to urge the screen into place on the support grid and retain the screen in this position as and while the toggle mechanisms are in the down position.

There are two embodiments shown. In one arrangement the apparatus is for screens having large apertures such as one-quarter inch or larger and it is anticipated that T-type bolts will be employed. The heads of these T-bolts are larger than the apertures in the screen and it is anticipated will cover two or three screen openings. The shanks of these T-bolts pass through a selected opening of the screen and into a threaded portion of a T-nut. The lower portion of these T-nuts, in the present instance, are preferably rectangular bars. Other shaped bars, of course, may be provided or a round bar with a keyway may be used, however, the T-nuts have compatible guide means to prevent their falling away from the upward orientation in which position the threaded holes are readily available for the entry of the threaded ends of the T-bolts. In the other apparatus arrangement the transverse bars are above the screen and depending from this transverse rod are support posts which carry, in this preferred instance, T-bars which extend the length of the screen. These T-bars are usually positioned above longitudinal supports carried by the frame and support the screen. This embodiment is particularly useful with a finer mesh screen. Most of the shaker frames have a small arch or lift at the center of the platform. Outer support pads are angled slightly to give an outward and downward thrust when the bar is brought downwardly into screen retaining condition.

In addition to the above summary the following disclosure is detailed to insure adequacy and aid in understanding of the inventin. This disclosure is not intended to cover each new concept no matter how it may later be disguised by variations in form or additions of further improvements. For this reason there has been chosen two embodiments of the screen for ready removal and retaining of this screen in a shaker apparatus. These embodiments have been chosen for the purposes of illustration and description as shown in the accompanying drawings wherein:

BRIEF DESCRIPTION OF THE DRAWINGS

In the following description and in the claims various details are identified by specific names for convenience. The names, however, are intended to be generic in their application. Corresponding reference characters refer to like members throughout the several figures of the drawings.

The two drawings accompanying, and forming part of, this specification disclosure certain details of construction for the purpose of explanation of the invention, but it should be understood that structural details may be modified without departure from the concept of the invention and that the invention may be incorporated in other structural forms than shown.

DESCRIPTION OF THE PREFERRED APPARATUS OF FIGS. 1, 2 AND 3

Figure 1:
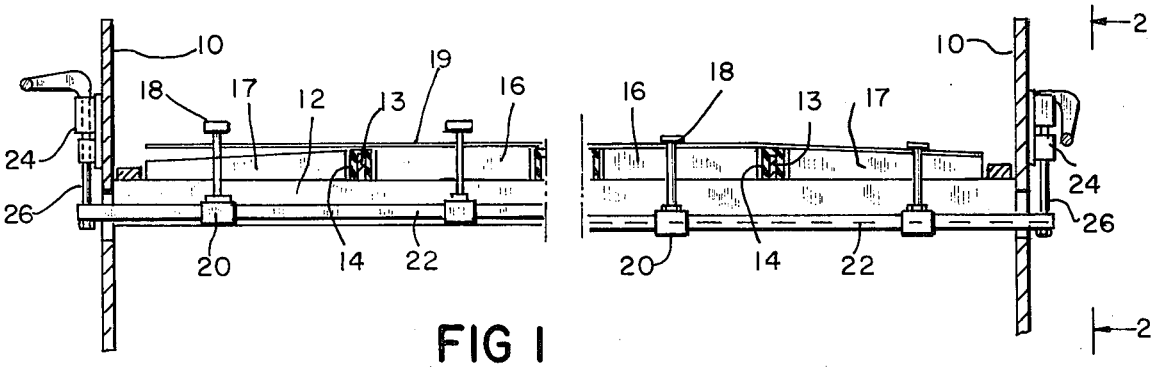
FIG. 1 represents an end view, partly in section and diagrammatically divided, showing in the left-hand view portion the toggle mechanism in its raised condition whereat the heads of the T-bolts are above the screen to be retained and in the right-hand view portion the toggle mechanism is in its down condition whereby the heads of the T-bolts are drawn downwardly to engage the screen and secure the screen on the screen supportive grid portion of the frame.
Figure 3:
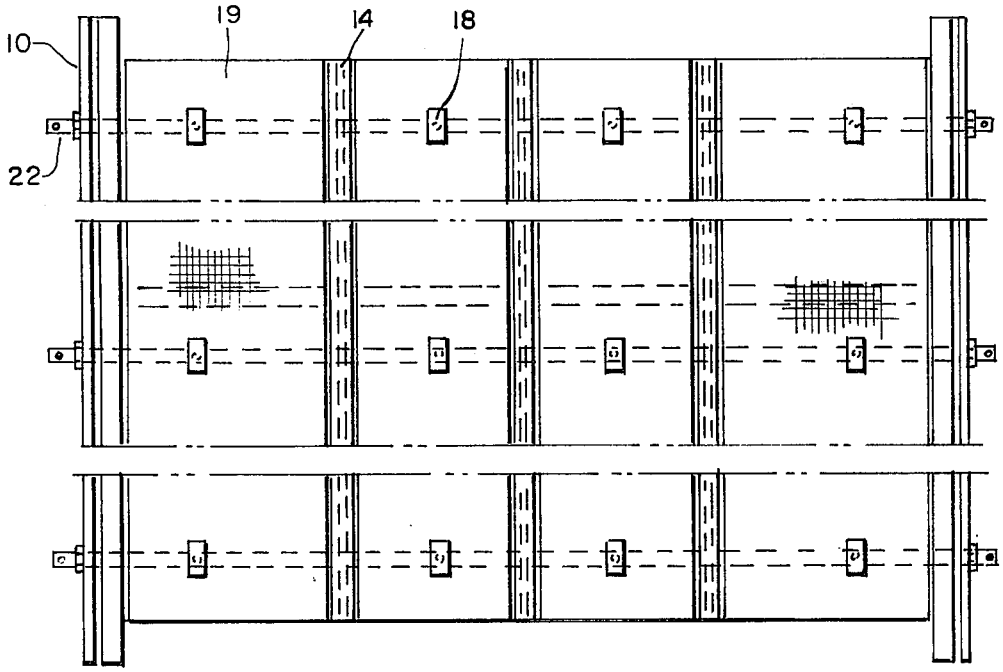
FIG. 3 represents a plan view, partly fragmentary and showing the shaker frame with the screen retaining means of FIG. 1, this view taken on the line 3—3 of FIG. 2 and looking in the direction of the arrows.

Referring now to the shaker apparatus of FIGS. 1. 2 and 3, there is shown a side frame 10 having portions that extend both above and below the general transverse grid which supports the screen This grid is shown with a curvature or contour whereby the screen carrying surface is higher in the center than at the side portions. The grid supporting the screen includes transverse support members 12 which carry longitudinal support members 13. Rubber covering 14 is shown applied to members 13 so as to reduce wear as well as cushioning the screen and providing a nonslip surface. Transverse rib members 16 and 17 extend between and are secured to the longitudinal memberd 13 to establish the desired contour of the top of the grid.

T-bolts 18 pass through apertures in the screen 19. These apertures are customarily one-quarter inch or larger. The heads of the bolts are sufficiently large so as to cover and engage two ro three apertures of the screen. The underside of the heads may be rubber covered or a rubber washer may be carried on the shank of the T-bolt 18. Other resilient means may be provided, if desired, to accommodate surface irregularities. T-nuts 20 are slidable on transverse rods 22.

Attached to the outer side of the side frame 10 are toggle mechanisms 24 which have a determined toggle action or throw. A rod member 26 of this toggle mechanism carried on its lower end one of the ends of the transverse rods 22 which, in this particular instance, may be a one inch square rod. The mounted T-nuts 20 carried by this rod are slidable on the rod. A square opening in the head of the T-nut orients this nut as to turning on the rod and also maintains the nut so that the threaded portion is always directed in an upward condition. These nuts are made slidable along the rods so that they may align with an aperture of the screen which is not always cut so as to be prepositioned. Extending through the screen and into the threaded portion of the T-nuts are the T-bolts which in mounted condition have a determined length. When the transverse rods are in the upper position, as in the left portion of FIG. 1, the heads of the T-bolts are above the screen. When the transverse rods are moved downwardly these heads engage the screen and draw it to the grid. An actuating rod 28 may be secured to two or more toggle mechanisms on a side of the shaker apparatus to enable simultaneous movement of the toggle mechanisms to be achieved.

USE AND OPERATION

It is anticipated that the frame 10 which has both side plates and end plates will have mounted on these side plates the toggle mechanisms 24 which are actuated for up and down movement. So that a simultaneous tightening of the screen may be accomplished, it is anticipated that the toggle handles are joined by the longitudinal rod 28 which is manipulated to cause simultaneous lifting and movement of each of the toggle mechanisms on one side of the shaker frame. T-bolts 18, when the toggle mechanisms 24 are raised to their upward positions are above and free of the screen 19 and by hand manipulation are unscrewed from the T-nuts 20. When all are removed, the screen 19 may be lifted from the frame and a new screen replaced after which the T-bolts are passed through the apertures in this screen and into threaded portions of the T-nuts. A few turns of the head of the bolts are made to bring the bolt into a threaded engagement and mounted condition in the T-nuts. When fully mounted to the desired depth, the heads of the T-bolts are still a determined distance above the screen 19, as depicted in FIG. 1, left-hand portion. The toggle mechanisms on both sides are now manipulated to the downward position causing the heads of the T-bolts to bring the screen snugly against the rubber covered support grid of the frame to retain the screen snugly thereagainst. The shaker frame is then moved in the usual shaking manner by mechanism not shown.

EMBODIMENT OF FIGS. 4 THROUGH 7

Since screens are also made of fine mesh and as the hand manipulation of T-bolts is rather time consuming there is provided an alternate embodiment in FIGS. 4 through 7. In these views toggle mechanisms 124 carry and move transverse bars 122 which are carried above the screen 119. In this embodiment the shaker frame 110 and the grid portions 113, 114, 116 and 117 are like members shown in FIG. 1, however, in this particular embodiment the side frames 110 are made to extend above the screen 119 so that upper transverse bar 122 may be positioned above and moved up and down a determined distance which distance may be about one inch or so.

Figure 2:
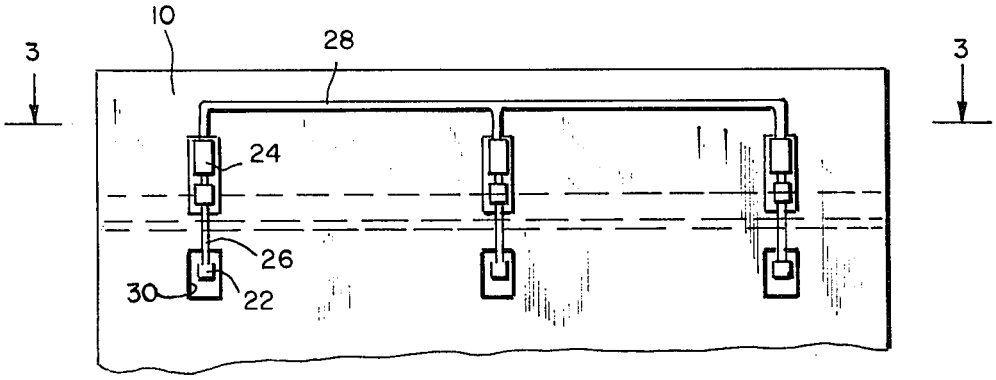
FIG. 2 represents a side view of the shaker apparatus frame, this view taken on the line 2—2 of FIG. 1 and looking in the direction of the arrows.

On and secured to these bars 122 are collar members 132 which carry on depending attachments longitudinal bars 139. The outer pressure members are carried by the collar members 120 and below these are sloped pressure pads 136 which are inclined at abouyt 10 to 15° from a level plane. Pins 134 and 135 allow T-members 136 to pivot slightly to find their own level when brought into a holding engagement with the screen 119. On the underportion of the T-bar 136 is a rubber pad 138 which retains the screen and is resilient enough to accommodate irregularities due to manufacture or wear. A like pad is carried on T-bar 139. The toggle mechanisms are connected on each side by means of bars 28, as in FIG. 2, and are simultaneously moved to their upper and lower limits with the movement of these bars. By this means large areas of the screen are tightened at the same time. With this apparatus two attendants are most useful. Both attendants can bring the toggle members down at the same time to remove all wrinkles from the screen and/or perforated plate.

USE AND OPERATION OF THE APPARATUS OF FIGS. 4 THROUGH 7

Figure 4:
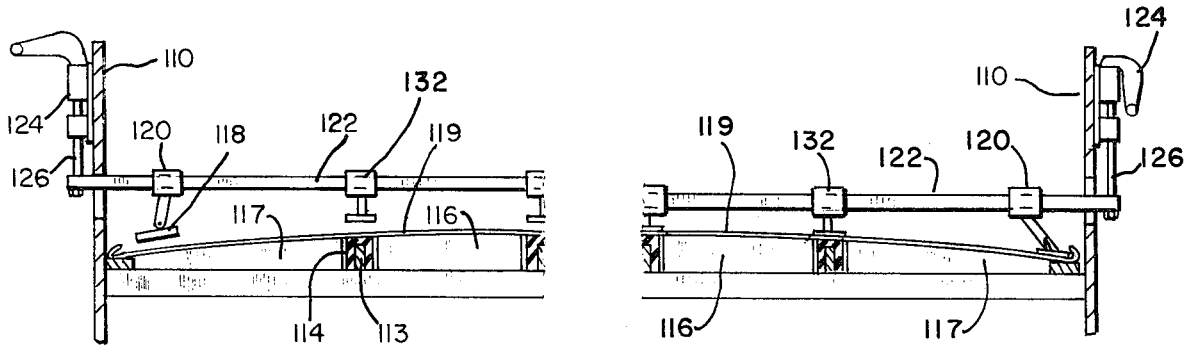
FIG. 4 represents an end view such as in FIG. 1 but with the transverse rods above the screen, said rods carrying pressure pads and in the left-hand view portion the toggle mechanisms are in the raised condition with the pressure pads free of the screen, and when the toggle mechanism is in its down condition as in the right-hand view portion the pressure pads are in screen retaining condition.
Figure 5:
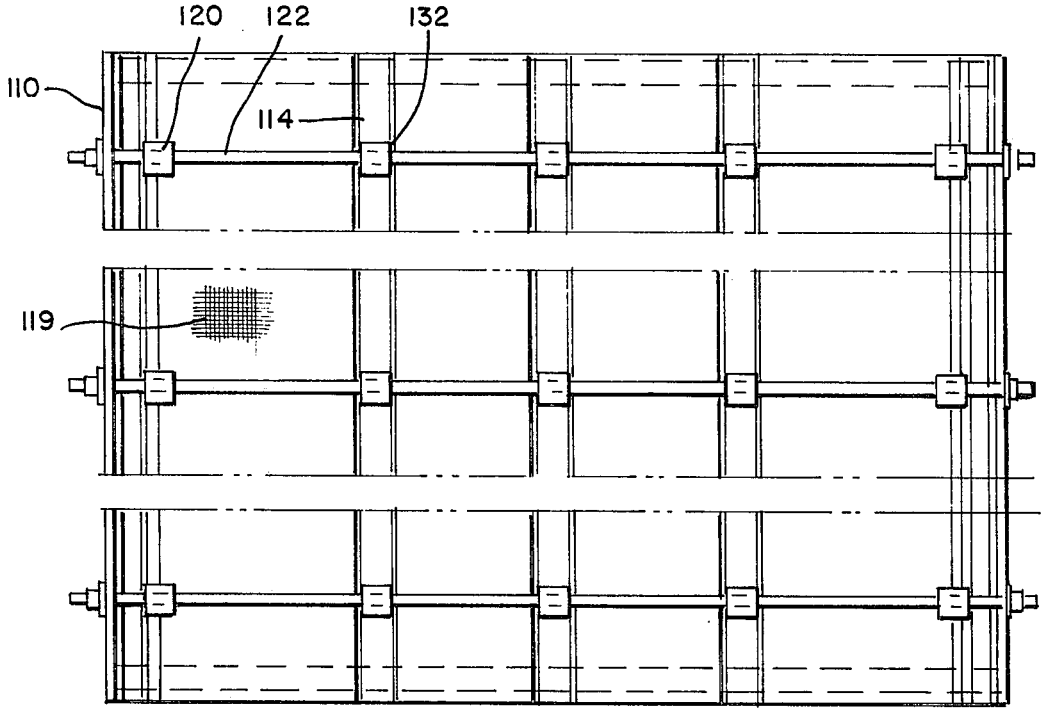
FIG. 5 represents a plan view, partly fragmentary, showing the shaker frame with the screen retaining means of FIG. 4.
Figure 7:
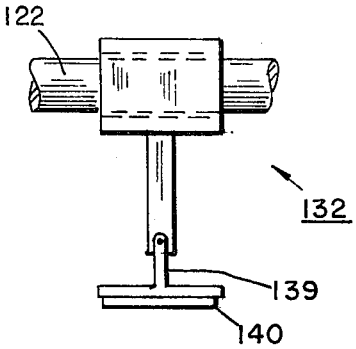
FIG. 7 represents an end view in enlarged scale and showing a pressure pad carried on the midportion of the shaker apparatus.
Figure 6:
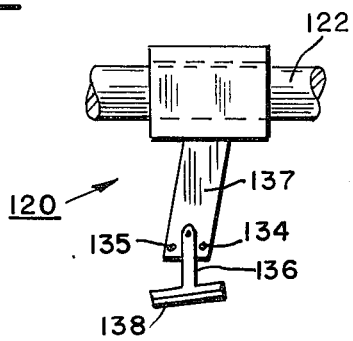
FIG. 6 represents an end view in enlarged scale and showng a pressure pad carried in a slightly inclined condition which is adapted to accommodate the contour of the screen supporting grid of the frame.

To remove the screen from the shaker of FIGS. 4 through 7, the toggle mechanisms are raised to their upper condition as in the left portion of FIG. 4. This causes the pressure pads to be lifted from screen 119 allowing the screen to be free. Preferably there is one to two inches of clearance between this screen and the T-bar pressure pads 136 and 139. The screen is slid out from underneath these pressure pads and a new one is slid in place. The attendants grasp this screen to move it to the desired position over the support grid and with one attendant on each side of the frame manipulate the toggle mechanisms 124 so that the toggle rods 126 carry the transverse rods 122 downwardly to bring the T-bars 136 and 139 and attached pads 138 and 140 into contact with the screen 119. As the downward pressure is increased and the toggle mechanisms are snapped into the lower holding condition, screen 119 is pushed slightly outward by the outer angled T-bar 136 and support 137 and is held tightly to the grid by the three middle T-bars 139 which are disposed immediately above the longitudinal grid supports which are rubber covered.

In operation, the shaker screen operated in a conventional manner and when the screen is damaged or is to be replaced by another size screen for a different sifting operation or for replacement because of wear, the toggle mechanisms are lifted to free the screen from the grid after which the tightening of the screen is repeated.

Terms such as "left", "right", "up", "down", "bottom", "top", "in", "out" and the like are applicable to the embodiments shown and described in conjunction with the drawings. These terms are merely for the purposes of description and do not necessarily apply to the position in which the shaker apparatus and the screen retaining apparatus may be constructed or used.

While particular embodiments of the holding apparatus have been shown and described it is to be understood the invention is not limited thereto since modifications may be made within the scope of the accompanying claims and protection is sought to the broadest extent the prior art allows.

What is claimed is:

1. Apparatus for retaining and ready release of the screen in a shaker frame, said apparatus including: (a) a shaker frame of conventional construction and having side and end members; (b) a screen of conventional construction and having apertures of determined and selected size; (c) a screen supporting grid carried by said frame and having a supporting surface contoured and conditioned to suit the screen to be supported during the shaking operation; (d) a plurality of toggle mechanisms carried on each of the side members, the toggle mechanisms arranged so that the toggle actuated member portion is moved selectively to an upper and a lower position at which limits of movement the mechanisms remain until manipulated to be moved to the other limit; (e) a transverse rod carried below the support grid at each end by one of the toggle mechanism actuated members, a toggle mechanism being arranged on each side member of the frame, and (f) a plurality of pressure pad portions carried by the transverse rods and including a plurality of T-nuts which is slidable along the rod and while mounted on the rod the head of the nut prevents the turning of the nut and there is mounted in each T-nut a T-bolt whose head is larger than the aperture in the screen and whose shank is sized to pass through the aperture in the screen, each pad portion when moved to the down position by the rod as it is moved by the toggle mechanism engaging the upper surface of the screen to urge the screen into retained condition on the supporting grid and when the toggle mechanism is moved to the upper position the pressure pads are carried upwardly by the transverse rods and from engagement with the screen which is now free for removal and replacement in the frame and on the support grid.

2. Apparatus for ready release and retaining of a screen as in claim 1 in which the transverse rods and the T-nuts have cooperative means for maintaining the nut in an established attitude maintaining means and with the threaded portion toward the screen while permitting the nut to slide along the rod.

3. Apparatus for ready release and retaining of a screen as in claim 2 in which the attitude maintaining means is provided by the rod which is rectangular in cross section and the head of the nut has a like-shaped rectangular throughway which allows the T-nut to slide on the rectangular rod.

4. Apparatus for ready release and retaining of a screen as in claim 2 in which the T-bolts have a resilient pad under the head portions five and the screen supporting surface of the grid has at least a portion provided with a resilient support surface.

5. Apparatus for retaining and ready release of the screen in a shaker frame, said apparatus including: (a) a shaker frame of conventional construction and having side and end members; (b) a screen of conventional construction and having apertures of determined and selected size; (c) a screen supporting grid carried by said frame and having a supporting surface contoured and conditioned to suit the screen to be supported during the shaking operation; (d) a plurality of toggle mechanisms carried on each of the side members, the toggle mechanisms arranged so that the toggle actuated member portion is moved selectively to an upper and a lower position at which limits of movement the mechanisms remain until manipulated to be moved to the other limit; (e) a transverse rod carried above the support grid and at each end by one of the toggle mechanism actuated members, a toggle mechanism being arranged on each side member of the frame, and (f) a plurality of pressure pad portions carried on downward extensions secured to the transverse rods, each pad portion when moved to the down position by the rod as it is moved by the toggle mechanism engaging the upper surface of the screen to urge the screen into retained condition on the supporting grid and when the toggle mechanism is moved to the upper position the pressure pads are carried upwardly by the transverse rods and from engagement with the screen which is now free for removal and replacement in the frame and on the support grid, said pressure pads including support by T-bars extending between and carried by two transverse rods and including at least one outer T-bar disposed adjacent the side of the frame, this outer bar having its face sloped to correspond to a like slope provided on the support grid, the outer bar as it is brought downwardly into holding engagement with the screen urging the side portions of the screen outwardly to bring the screen to a taut condition.

6. Apparatus for ready release and retaining of a screen as in claim 5 in which those faces of the pressure pads toward the screen and the screen supporting surface of the grid has resilient screen engaging portions.

7. Apparatus for ready release and retaining of a screen as in claim 1 in which the toggle mechanisms along a side of the frame are operatively connected so that along one side the toggle mechanisms are actuated substantially simultaneously from an upper to a lower bar position and vice versa.

8. Apparatus for ready release and retaining of a screen as in claim 5 in which the toggle mechanisms along a side of the frame are operatively connected so that along one side the toggle mechanisms are actuated substantially simultaneously from an upper to a lower bar position and vice versa.

* * * * *